US007568491B2

(12) United States Patent
Banfill et al.

(10) Patent No.: US 7,568,491 B2
(45) Date of Patent: Aug. 4, 2009

(54) VEHICLE-MOUNTED AWNING

(76) Inventors: Jeffrey A. Banfill, P.O. Box 410186, Big Water, UT (US) 84741-2186; Peter J. Thompson, P.O. Box 410142, Big Water, UT (US) 84741-2142

( * ) Notice: Subject to any disclaimer, the term of this patent is extended or adjusted under 35 U.S.C. 154(b) by 344 days.

(21) Appl. No.: 11/713,665

(22) Filed: Mar. 5, 2007

(65) Prior Publication Data

US 2007/0209693 A1 Sep. 13, 2007

Related U.S. Application Data

(60) Provisional application No. 60/779,446, filed on Mar. 7, 2006.

(51) Int. Cl.
*E04H 15/06* (2006.01)

(52) U.S. Cl. ..... 135/88.08; 135/88.15; 135/136; 135/117; 296/163; 296/159

(58) Field of Classification Search ..... 135/87, 135/88.01, 88.08, 88.13, 96, 136, 117, 901; 296/159, 161; 297/180.13; 280/166
See application file for complete search history.

(56) References Cited

U.S. PATENT DOCUMENTS 413,493 A * 10/1889 Clawson ..... 296/99.1
2,383,192 A 8/1945 Heil
2,907,077 A 10/1959 Pugsley
3,020,919 A 2/1962 Crump
3,115,362 A 12/1963 Spurrier
3,410,598 A 11/1968 Davis et al.
3,479,079 A * 11/1969 Coursault ..... 296/26.06
3,863,977 A 2/1975 Hardinge
3,923,336 A 12/1975 Price, Sr.
3,968,809 A 7/1976 Beavers
4,088,363 A * 5/1978 Palmer ..... 296/161
4,294,486 A 10/1981 Espejo
4,325,448 A * 4/1982 Pivar ..... 180/215
4,519,409 A 5/1985 Kinney et al.
4,907,728 A * 3/1990 Giblet ..... 224/585
5,226,689 A * 7/1993 Roe et al. ..... 296/159
5,419,607 A 5/1995 Oliveira (Continued)

FOREIGN PATENT DOCUMENTS

GB 2393155 A * 3/2004

(Continued)

*Primary Examiner*—Winnie Yip
(74) *Attorney, Agent, or Firm*—Richard C. Litman

(57) ABSTRACT

The vehicle-mounted awning is a quick setup framework that supports a weatherproof fabric canopy, and is configured for use to the rear of a vehicle. A multi-sectioned bumper bar attaches to the hitch receiver of a vehicle. Opposing ends of the bumper bar have vertical extension pieces, each extending vertically and having a slightly arcuate free end for support of an arcuate multi-sectioned upper side panel frame on either side of the bumper bar. Multi-sectioned lower side panel frames are pivotally connected to opposing ends of the bumper bar. Upper and lower side panel frames are removably connected at their distal ends to provide cantilevered support. Additional multi-sectioned framework extends rearward protective coverage. A flexible water-resistant fabric is wrapped over the support framework to provide a covered canopy region. The framework of the device comprises a plurality of collapsible elements for storage in a small bag.

11 Claims, 5 Drawing Sheets

U.S. PATENT DOCUMENTS

| | | | | |
|---|---|---|---|---|
| 5,601,104 | A | 2/1997 | Perkins | |
| 5,641,192 | A * | 6/1997 | Smith et al. | 296/100.06 |
| 5,738,130 | A | 4/1998 | Thomas | |
| 5,820,189 | A | 10/1998 | Tew | |
| 5,971,471 | A | 10/1999 | Gardner | |
| 6,070,925 | A | 6/2000 | Moldofsky | |
| 6,082,269 | A | 7/2000 | Padberg | |
| 6,179,367 | B1 * | 1/2001 | Bowen | 296/161 |
| 6,179,368 | B1 | 1/2001 | Karlsson | |
| 6,202,664 | B1 | 3/2001 | Shenton, Jr. et al. | |
| 6,394,118 | B1 | 5/2002 | Cikanowick et al. | |
| 6,439,645 | B1 * | 8/2002 | Pedersen | 296/161 |
| 6,607,002 | B2 | 8/2003 | Reese | |
| 6,802,327 | B2 | 10/2004 | Koss | |
| 6,871,896 | B1 | 3/2005 | Owen | |
| 7,059,660 | B1 * | 6/2006 | Juola | 296/163 |
| 7,234,760 | B1 * | 6/2007 | Crean | 296/180.1 |
| 7,255,121 | B2 * | 8/2007 | Milner et al. | 135/88.01 |
| 2002/0109374 | A1 | 8/2002 | Cargill | |

FOREIGN PATENT DOCUMENTS

| | | |
|---|---|---|
| JP | 2-248585 | 10/1990 |
| JP | 6-58021 | 3/1994 |

* cited by examiner

VEHICLE-MOUNTED AWNING

CROSS-REFERENCE TO RELATED APPLICATION

This application claims the benefit of U.S. Provisional Patent Application Ser. No. 60/779,446, filed Mar. 7, 2006.

BACKGROUND OF THE INVENTION

1. Field of the Invention

The present invention relates to awnings, canopies, sunshades, and the like, and particularly to a vehicle-mounted awning that provides for quick setup of an awning attachable to a vehicle that has a variety of outdoor applications.

2. Description of the Related Art

Temporary awnings have been utilized during many outdoor activities, such as hunting, camping, tailgating, picnicking, and the like to provide protection from the sun and rain. Many freestanding awnings are available. However, such awnings usually require mounting stakes driven into the ground, which is not always permitted by the landowner or by park regulations, and is sometimes not an available option because of the terrain.

Many awnings have been developed that extend from the side of the vehicle, but such awnings either do not extend low enough and/or require that at least one end either be staked to the ground or be anchored by the weight of the vehicle. The usefulness of structures having such requirements is limited because such devices may not be conveniently used where the anchoring vehicle must be parked directly beside other vehicles, such as in a parking lot, or where the anchoring vehicle must be moved from time to time, such as in a parade, and the like. Moreover, many such awnings have a very long side that must be supported well above ground, which may not be an option to a low-riding vehicle.

In addition, such awnings or canopies often require considerable time and effort to setup and to break down for transport and storage, or do not provide for compact storage.

Thus, a vehicle-mounted awning solving the aforementioned problems is desired.

SUMMARY OF THE INVENTION

The vehicle-mounted awning has a quick setup framework that supports a weather resistant fabric canopy, and is primarily configured for use to the rear of a vehicle. A multi-sectioned bumper bar attaches to the hitch receiver of a vehicle. Opposing ends of the bumper bar have vertical extension members or posts, each extending vertically and having a slightly arcuate free end for support of an arcuate, multi-sectioned upper side panel on either side of the bumper bar. Multi-sectioned lower side panel frames are pivotally connected to opposing ends of the bumper bar.

Upper and lower side panel frames are removably connected at distal ends to provide cantilevered support. A supporting cross member is disposed laterally between, and is attached to, the upper side panel frames.

Additional multi-sectioned framework extends rearward, forming an arcuate closed loop to laterally interconnect the two side panels for additional protective coverage. A flexible water-resistant fabric is wrapped over the support framework to provide a covered canopy region. The framework of the device comprises a plurality of collapsible elements for storage in a small bag.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
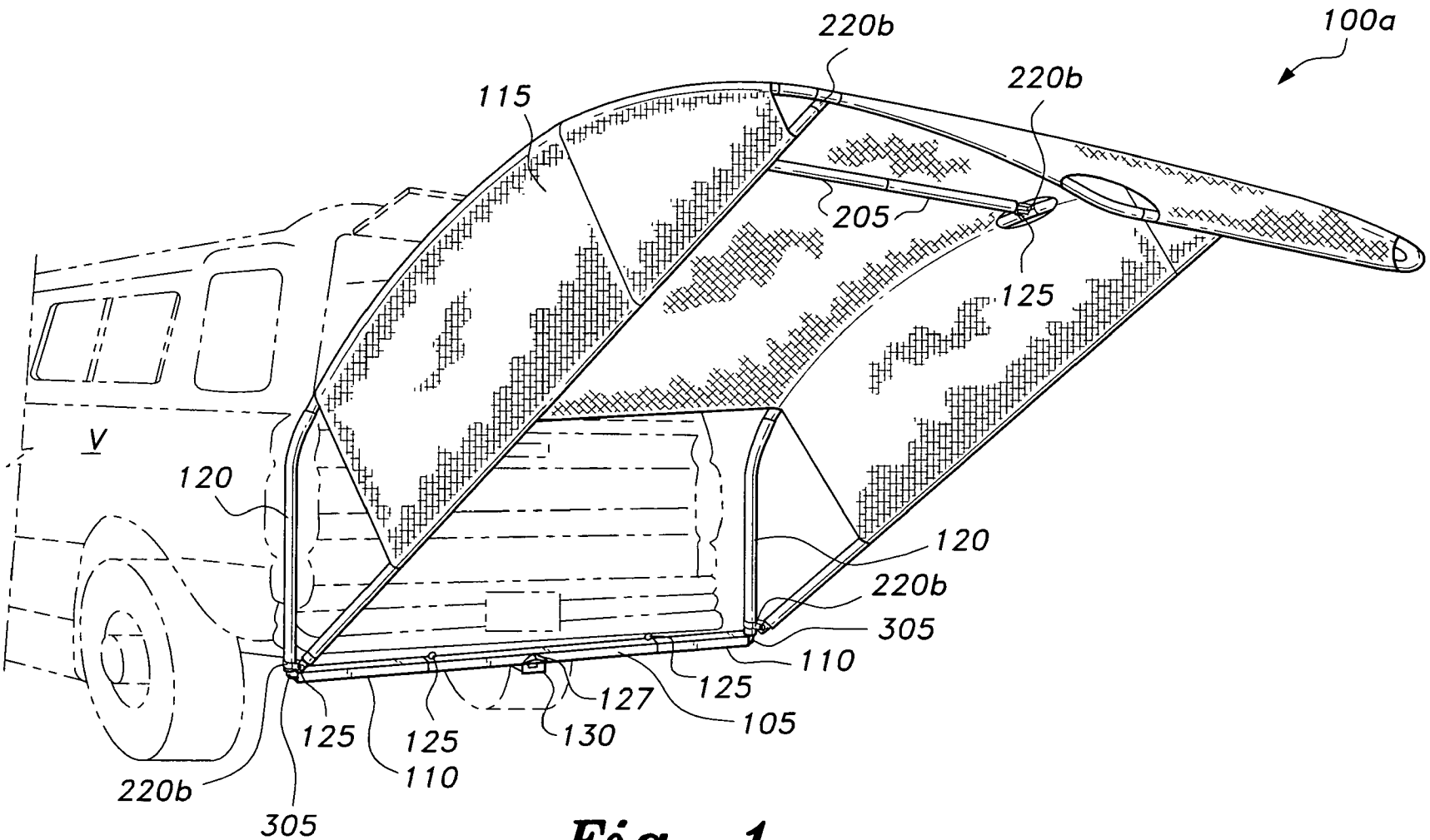
FIG. 1 is an environmental, perspective view of a vehicle-mounted awning according to the present invention.
Figure 2:
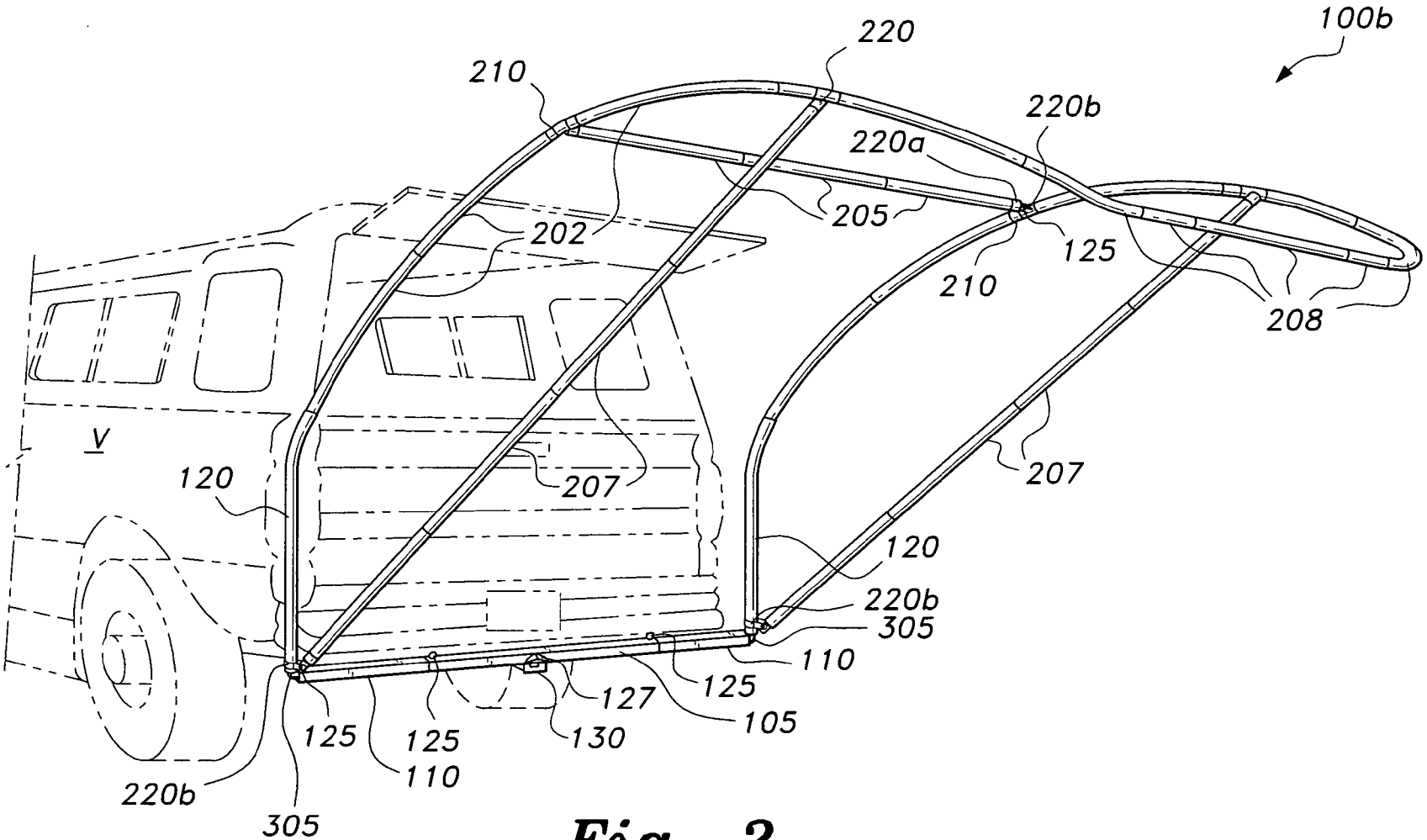
FIG. 2 is an environmental, perspective view of the framework for the vehicle-mounted awning according to the present invention.
Figure 3:
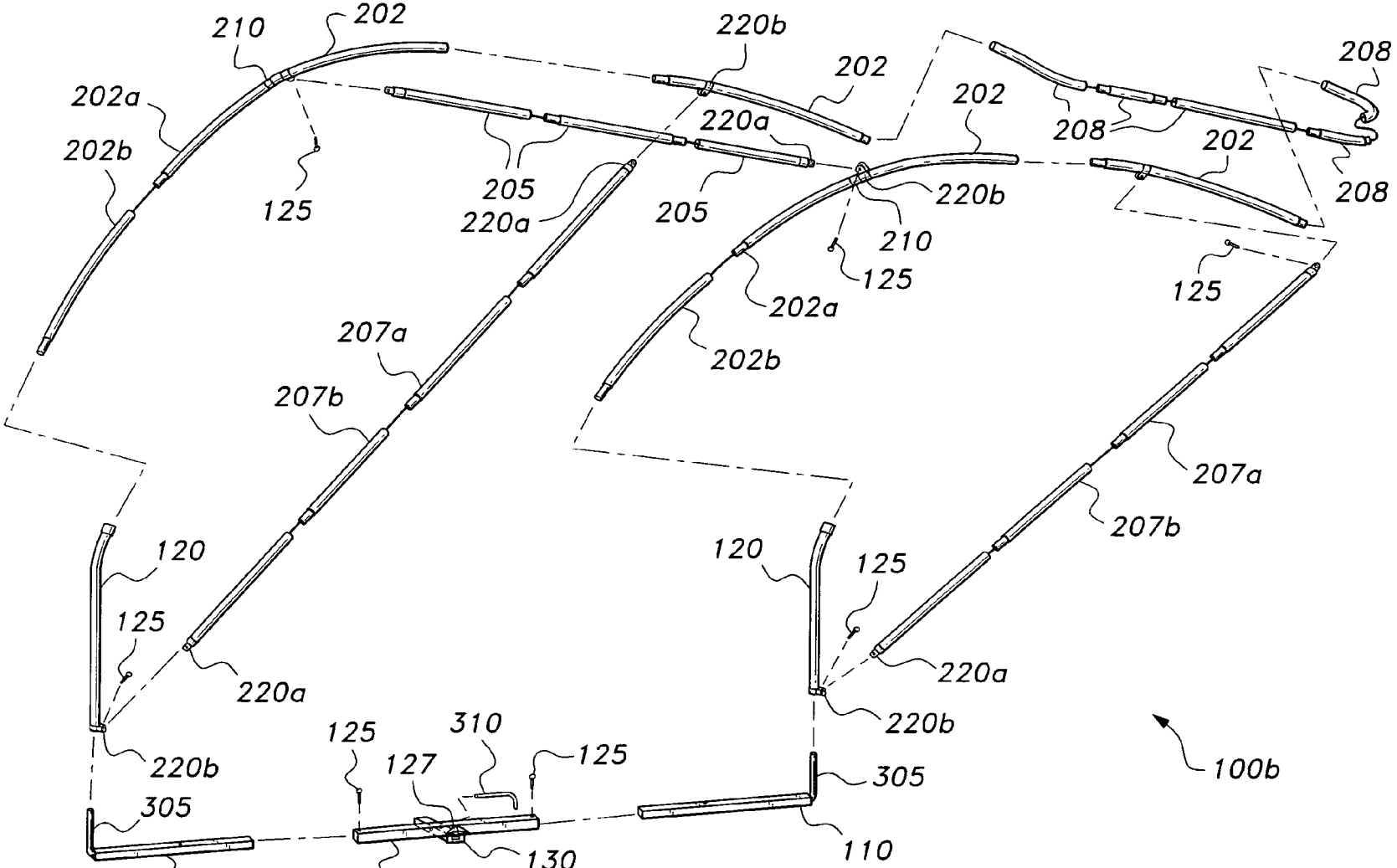
FIG. 3 is an exploded perspective view of the framework for the vehicle-mounted awning according to the present invention.

As shown in FIGS. 1 and 3, the present invention is a vehicle-mounted awning 100*a* having a quick setup framework that supports a weather proof fabric canopy, and that is primarily configured for use to the rear of a vehicle. V. A multi-sectioned bumper bar, preferably made of tubular rectangular stock, comprising extension sections 110 and middle section 105 attaches by means of hitch receiver connecting member 130 to the hitch receiver of the vehicle V. Hitch receiver connecting member 130 is secured to the hitch receiver of the vehicle V by hitch pin 310. As shown in FIGS. 1 through 3, preferably round stock stubs 305 are attached to respective extension sections 110 at opposing ends of the bumper bar and are disposed to provide vertical support for removably attachable vertical extension members 120. The vertical extension members 120 each extend vertically and have a slightly arcuate free end for support of opposing arcuate multi-sectioned upper side panel support members 202. Reversing the vertical extension members 120 so that the arcuate free ends point toward the front of vehicle V permits a forward disposition of the awning 100*a* so that a truck bed or flat bed may be protected from the environment by the awning 100*a*.

A vehicle's weight, being distributed away from the vehicle-mounted awning 100*a*, produces a counter-torque applied to the bumper bar when the bumper bar is secured to a hitch receiver on the vehicle V. The counter-torque applied to the bumper bar firmly anchors the vehicle-mounted awning 100*a* in position without the need for mounting stakes, legs, guy wires and the like. Thus, the vehicle-mounted awning 100*a* may be deployed in any location capable of stably supporting the weight of the vehicle V.

The use of the bumper bar permits the awning 100*a* to be used with a wide variety of vehicles having a hitch receiver. It should be noted that a laterally disposed member comprising a unitary bumper bar may be utilized, instead of a multi-section bumper bar having a middle section 105 attached to end sections 110, as illustrated.

Figure 4:
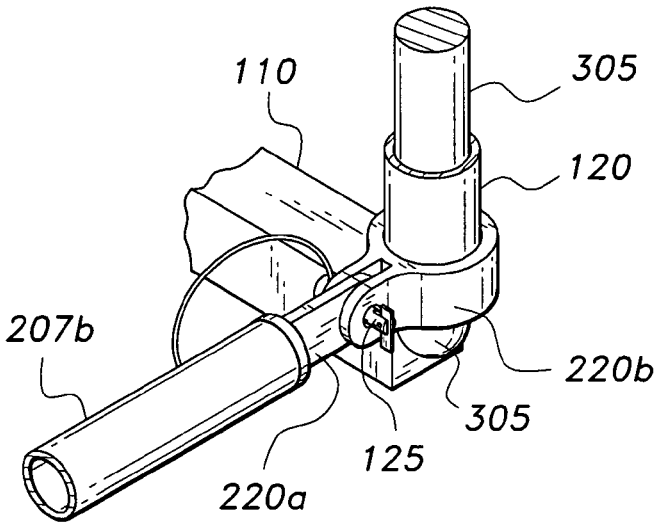
FIG. 4 is a perspective view of a framework connector for the vehicle-mounted awning according to the present invention.

Proximal ends, i.e., ends closest to the bumper bar 105, 110, of multi sectioned lower side panel support members 207 are pivotally and removably attached to opposing ends of the bumper bar. As shown in FIG. 4, the pivotal and removable attachment may preferably comprise a hollow cylindrical component of a marine-style jaw slider 220*b* slipped over the stub 305 at the end of vertical extension member 120 and secured adjacent to the bumper bar extension member 110 so that a slotted component of the jaw slider 220*b* is capable of receiving an eye end 220*a* attached to the proximal end of a section 207*b* of multi-sectioned lower side panel support member 207. When holes of the slotted component of jaw slider 220*b* are coaxially aligned with holes of the eye end 220*a*, a quick release locking pin 125 is inserted to secure the attachment.

Figure 5:
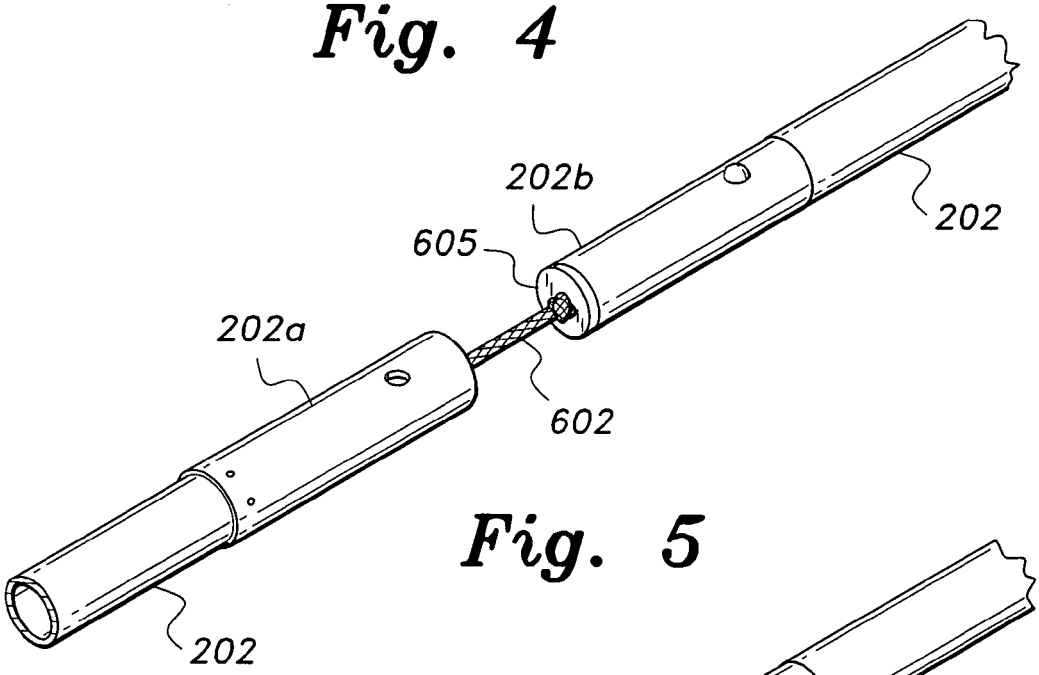
FIG. 5 is a partially exploded view of a multi-sectioned member for the vehicle-mounted awning according to the present invention.

As shown in FIG. 5, individual sections of the multi-sectioned upper side panel support 202 generally are tubular and loosely connected together by a tensioning bungee cord 602, which is threaded through and about the hollow axial centers of the members of side panel support 202. Baseline tensioning of the cord 602 may be maintained by a bungee cord tie-off point at an end cap 605 disposed on opposing ends of the side panel support assembly 202.

Adjacent sections of the upper side panel support assembly 202 have collar and sleeve fittings, including radial holes in the collar 202*b*, and corresponding radially disposed spring-loaded buttons in the sleeve 202*a*, so that the bungee tensioned members are securely attached when the collar 202*b* is fitted over the sleeve 202*a* and the spring-loaded buttons are locked in place through the collar radial holes, thus forming a quick release removable shock-corded compression joint.

Figure 6:
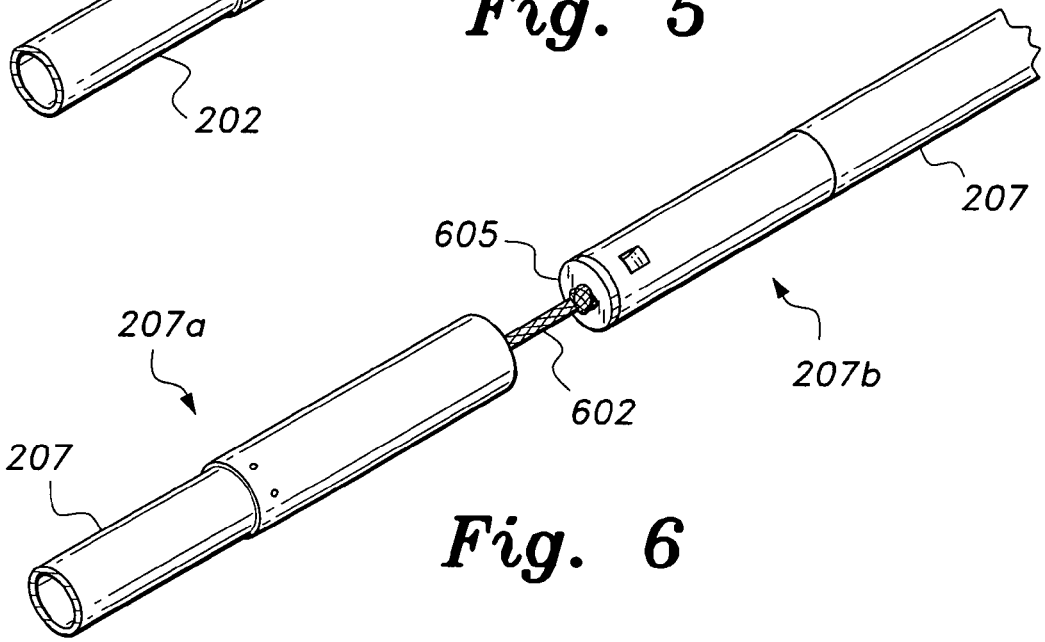
FIG. 6 is a partially exploded view of another multi-sectioned member for the vehicle-mounted awning according to the present invention.

Similarly, as shown in FIG. 6, adjacent sections of the lower side panel support assembly 207 have bungee 602, collar 207*a* and sleeve 207*b* fittings to form a quick release removable shock-corded compression joint for quick setup and breakdown of the lower side panel support assembly 207.

Upper 202 and lower 207 side panel frames are removably attached to each other at their distal ends to provide cantilevered support. The removable attachment of upper side panel support member 202 to lower side panel support member 207 is comprised of the cylindrical part of a slider, such as jaw slider 220*b*, being slipped over tubing of upper side panel frame 202, leaving the eye end-receiving component of jaw slider 220*b* disposed in a position ready to receive an eye end-fitted terminal end of lower side panel frame 207. Quick release locking pin 125 secures the removable attachment for ease of setup and breakdown of the upper 202 and lower 207 side panel frames, i.e., members, from each other.

As shown in FIG. 2, left and right upper 202 side panel frames are laterally braced by a combination of the side panel attachments to the vertical extension members 120 and a multi-sectioned cross member 205 disposed laterally between side panel frames 202 and having terminal ends attached to the opposing, i.e., left and right, side panel frames 202.

As shown in FIG. 3, the terminal ends of multi-sectioned cross member 205 are fitted with eye ends 220*a*, and removably secured to the side panel frames 202 with jaw slides 220*b* and quick release locking pins 125. Adjacent sections of the multi-sectioned cross member 205 have a bungee disposed through a hollow center of the cross member 205, and tensioned with a cap such as end cap 605. Collar and sleeve fittings, in conjunction with the tensioned bungee, provide quick release removable shock-corded compression joints for quick setup and breakdown of the cross member 205 from the upper side panel frames 202.

To expand a usable footprint of protective coverage, a looping multi-sectioned framework 208 is provided, which extends distally beyond a terminal end of the upper side panel support assembly 207. The looping multi-sectioned framework 208 forms an arcuate closed loop, which creates a distal boundary of the entire awning 100*a*. As shown in FIG. 2, the arcuate closed loop formed by looping multi-sectioned framework 208 laterally interconnects the two side panel terminal ends.

Figure 7:
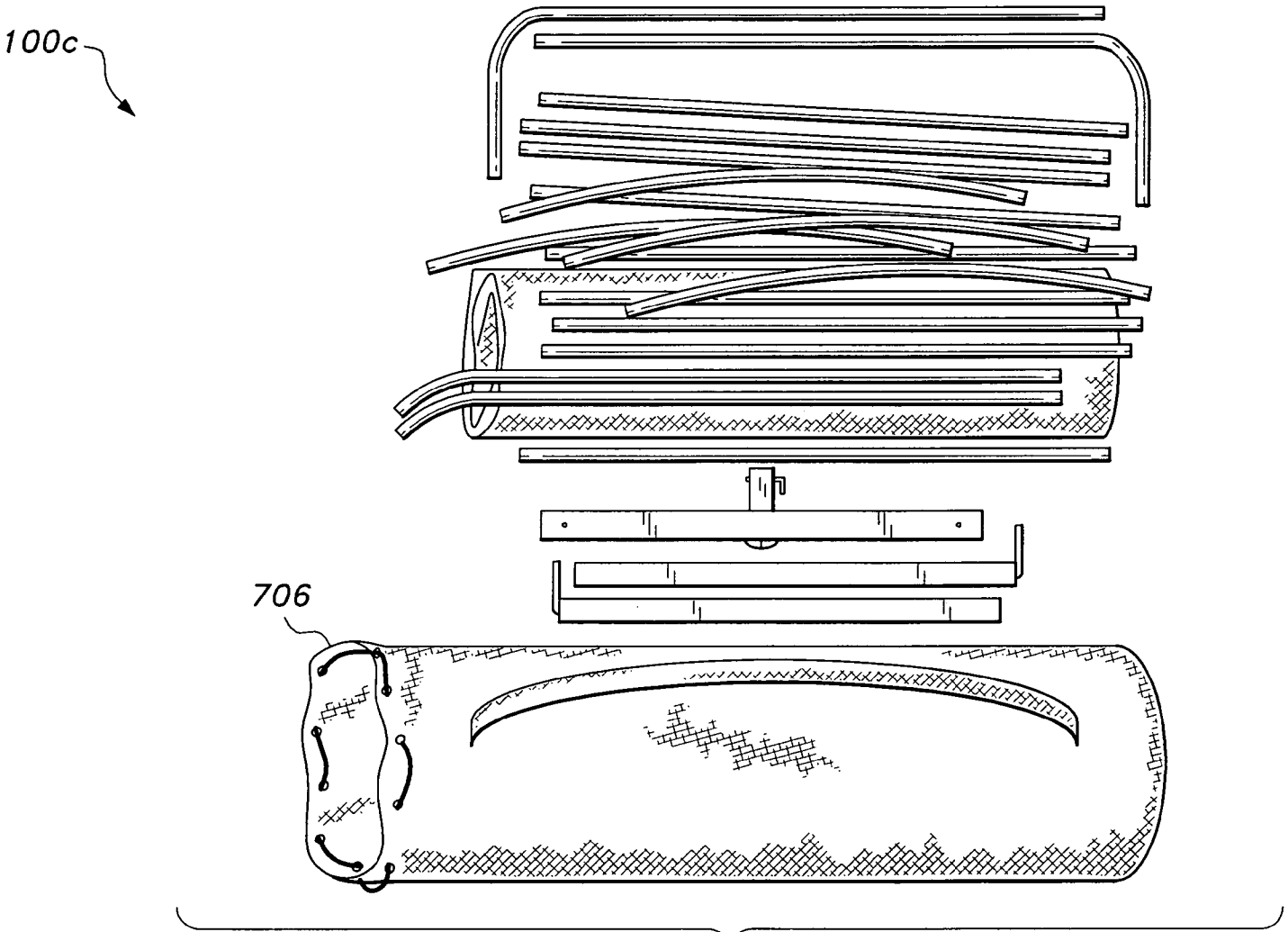
FIG. 7 is an environmental perspective view of the disassembled vehicle-mounted awning according to the present invention ready for storage in a custom storage bag.

A flexible water-resistant fabric is wrapped over the support framework to provide a protective covered region. Straps having hook and loop fasteners (not shown), or other suitable attachment means, may be utilized to retain the flexible water-resistant fabric in position over the support framework. As shown in FIG. 7, the multi-sectioned framework of the device breaks down into a plurality of collapsible elements 100*c* suitable for storage in a small bag 706.

It is to be understood that the present invention is not limited to the embodiment described above, but encompasses any and all embodiments within the scope of the following claims.

We claim:

1. A vehicle-mounted awning, comprising:

a laterally disposed bumper bar adapted for removable attachment to a vehicle hitch receiver;

first and second vertical extension members removably attached at opposing ends of the laterally disposed bumper bar, the vertical extension members being arcuate toward their free ends;

first and second multi-sectioned upper side panel support members respectively connected to the free ends of the first and second vertical extension members, first and second multi-sectioned lower side panel support members having proximal ends pivotally and removably attached to respective opposing ends of the laterally disposed bumper bar, the upper and lower side panel support members being removably attached to each other at their respective distal ends;

a multi-sectioned cross member disposed laterally between the upper side panel support members, the cross member having terminal ends attached to the opposing upper side panel support members;

a looping multi-sectioned framework extending distally beyond terminal ends of the upper side panel support assemblies, the looping multi-sectioned framework forming an arcuate closed loop, thereby creating a distal boundary of the entire vehicle-mounted awning, the arcuate closed loop laterally interconnecting terminal ends of the two upper side panel support members; and a flexible, water-resistant fabric wrapped over the support framework to provide a protective covered region, the flexible water-resistant fabric having removable attachment means for retaining the fabric over the support framework.

2. The vehicle-mounted awning, according to claim 1, further comprising: the bumper bar being multi-sectioned tubular rectangular stock, comprising extension sections as well as a middle section, the middle section having a hitch receiver connecting member for the removable attachment of the bumper bar to the vehicle hitch receiver.

3. The vehicle-mounted awning, according to claim 1, wherein the bumper bar is of unitary construction having a hitch receiver connecting member at its center for the removable attachment of the bumper bar to the vehicle hitch receiver.

4. The vehicle-mounted awning, according to claim 1, wherein the vertical extension members are reversible to facilitate construction of the awning toward the front of the vehicle.

5. The vehicle-mounted awning, according to claim 1, wherein the bumper bar mount to the vehicle provides an anchor for the awning assembly thereby eliminating the requirement for mounting stakes, legs and guy wires.

6. The vehicle-mounted awning, according to claim 1, wherein the pivotally and removable attachment of the lower side panel support members further comprises a hollow cylindrical component of a marine-style jaw slider slipped over a stub at the end of each vertical extension member so that a slotted component of the jaw slider is capable of receiving an eye end attached to the proximal end of a section of the multi-sectioned lower side panel support member.

7. The vehicle-mounted awning, according to claim 6, further comprising: a quick release locking pin capable of being inserted in holes of the slotted component of the jaw slider when the holes are coaxially aligned with holes of the eye end to secure the attachment.

8. The vehicle-mounted awning, according to claim 1, wherein individual sections of the multi-sectioned upper side panel support members are tubular, being loosely connected together by a tensioning bungee cord which is threaded through and about hollow axial centers of the support members.

9. The vehicle-mounted awning, according to claim 8, further comprising: end caps disposed on opposing ends of the side panel support assembly the end caps serving as bungee cord tie-off points in order to provide a baseline tensioning of the bungee cord through the support members.

10. The vehicle-mounted awning, according to claim 8, further comprising: collar and sleeve fittings, in conjunction with the tensioned bungee, to provide quick release removable shock-corded compression joints for quick setup and breakdown of the cross member from the upper side panel frames.

11. The vehicle-mounted awning, according to claim 8, further comprising: a small storage bag capable of storing the multi-sectioned members when they are collapsed and disassembled.

* * * * *